United States Patent [19]

Kohtaka

[11] Patent Number: 5,033,539

[45] Date of Patent: Jul. 23, 1991

[54] HEAT EXCHANGER APPARATUS

[75] Inventor: Ikuo Kohtaka, Hiroshima, Japan

[73] Assignee: Babcock-Hitachi Kabushiki Kaisha, Tokyo, Japan

[21] Appl. No.: 438,947

[22] Filed: Nov. 17, 1989

Related U.S. Application Data

[63] Continuation of Ser. No. 49,324, May 13, 1987, abandoned.

[30] Foreign Application Priority Data

May 13, 1986 [JP] Japan ..... 61-107723

[51] Int. Cl.[5] ..... F28D 15/02

[52] U.S. Cl. ..... 165/104.14; 165/104.21; 165/104.27

[58] Field of Search ..... 165/104.14, 104.21

[56] References Cited

FOREIGN PATENT DOCUMENTS 155187 12/1980 Japan ..... 165/104.14
165494 12/1980 Japan ..... 165/104.14
2156505 10/1985 United Kingdom ..... 165/104.14

*Primary Examiner*—Albert W. Davis, Jr.
*Attorney, Agent, or Firm*—Antonelli, Terry, Stout & Kraus

[57] ABSTRACT

A heat exchanger apparatus has a hot-fluid casing and a cold-fluid casing which are separated from each other by a partition plate and through which a fluid of a higher temperature and a fluid of a lower temperature pass, respectively. The hot-fluid casing accommodates a plurality of heat transfer tubes charged with a heat medium and connected at their ends to respective headers so as to constitute an evaporator panel. The cold-fluid casing also accommodates a plurality of heat transfer tubes similar to that in the hot-fluid casing and connected at their ends to respective headers so as to constitute a condenser panel. The header on the medium outlet side of the evaporator panel and the header on the medium inlet side of the condenser panel are positioned substantially at the same level. The header on the medium outlet side of the condenser panel is disposed above the header on the medium inlet side of the evaporator panel and these headers are connected to each other through a connection pipe.

11 Claims, 6 Drawing Sheets

HEAT EXCHANGER APPARATUS

This application is a continuation of application Ser. No. 049,324, filed May 13, 1987, now abandoned.

FIELD OF THE INVENTION AND RELATED ART STATEMENT

The present invention relates to a heat exchanger apparatus and, more particularly, to a heat exchanger apparatus of the type which employs heat transfer tubes.

Nowadays, heat pipes are widely used as heat-transfer elements of heat exchangers by virtue of their superior heat transfer characteristics. However, heat pipes are expensive.

In another arrangement in which the heat transfer tubes each provided with a plurality of fins are incorporated, the assembly work is quite laborious and time-consuming.

Accordingly, the separated type heat exchanger apparatus has been proposed, in which a hot-fluid casing and a cold-fluid casing are separated from each other. However, in this heat exchanger apparatus, it is necessary to place the hot-fluid casing considerably higher than the cold-fluid casing so as to sufficiently circulate the heat medium. Thus the size of the apparatus as a whole becomes large.

SUMMARY OF THE INVENTION

Accordingly, an object of the present invention is to provide a heat exchanger apparatus capable of eliminating the above-described problems.

To this end, according to the present invention, there is provided a heat exchanger apparatus in which the hot-fluid casing and the cold-fluid casing are arranged adjacent to each other so as to realize a compact construction of the heat exchanger apparatus as a whole. The panels constituted by the heat transfer tubes are arranged in the hot-fluid casing and the cold-fluid casing as the evaporator panel and the condenser panel, respectively, so as to prevent the heat transfer tubes from penetrating the partition plate. These panels are connected with each other through connection pipes and are arranged at a suitable height difference so as to ensure sufficient circulation of the heat medium through these panels.

According to this arrangement, the construction of the heat exchanger apparatus as a whole is made compact and troublesome works such as assembly of the partition plate together with the heat transfer tubes are avoided, thus contributing to a reduction in the production cost.

The above and other objects, features and advantages of the invention will become clear from the following description of the preferred embodiment in conjunction with the accompanying drawings.

DESCRIPTION OF THE PREFERRED EMBODIMENTS

Figure 9:
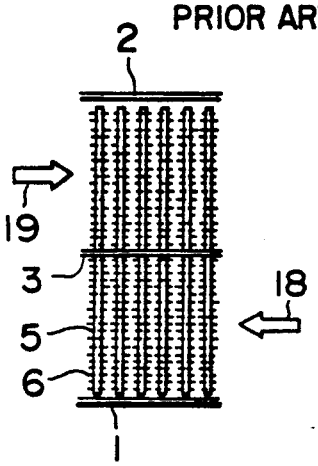
FIG. 9 PRIOR ART
FIGS. 9, 10 and 11 are side elevational views of conventional heat exchanger apparatus.
Figure 10:
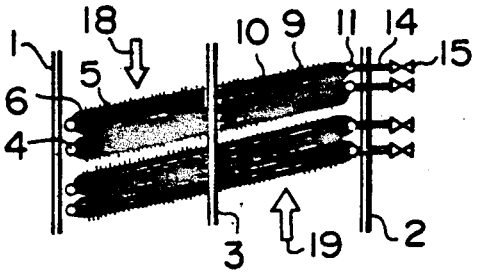
FIG. 10 PRIOR ART
Figure 11:
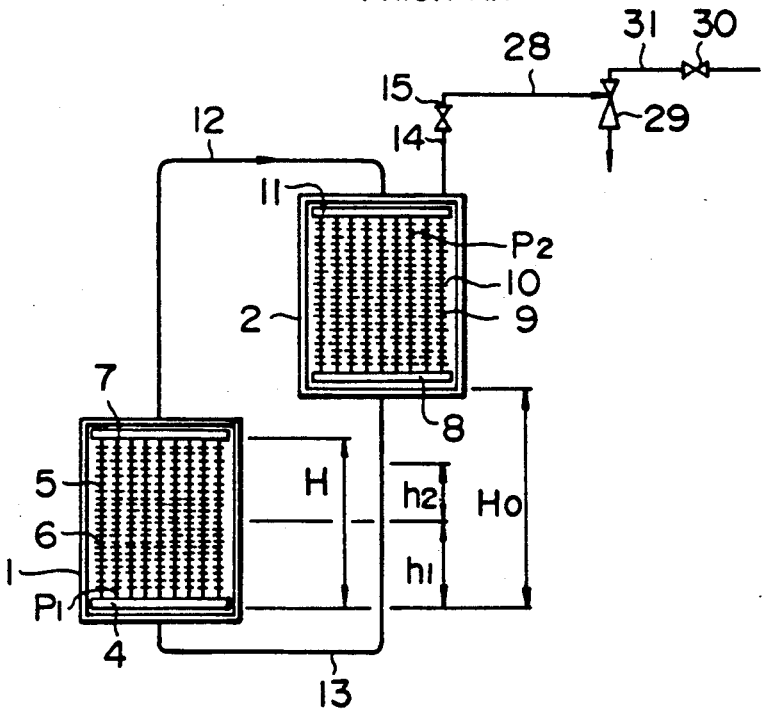
FIG. 11 PRIOR ART

At first, FIGS. 9 to 11 show one example of the well-known heat-pipe type heat exchanger apparatus which is used in various plants such as chemical plants and power plants. More specifically, the heat exchanger apparatus shown in FIG. 9 has a plurality of heat transfer tubes 5 constituted by independent heat pipes which are of gravity type in which the condensate of the heat medium moves back by the force of gravity. The heat exchanger apparatus is sectioned by a central partition plate 3 secured to lengthwise mid portions of the heat transfer tubes 5 into two sections, namely, a cold-fluid casing 2 above the partition plate 3 and adapted for passing a fluid 19 of a lower temperature and a hot-fluid casing 1 below the partition plate 3 and adapted for passing a fluid 18 of a higher temperature. The heat from fluid 18 of the higher temperature is transferred to the heat medium in the heat transfer tubes 5 so as to generate vapor of the medium. The medium vapor ascends in a space of each heat transfer tube 5 to enter the cold-fluid casing 2 where the medium vapor is cooled. As a result of heat exchange with the fluid 19 of the lower temperature, the medium vapor is condensed into liquid phase, while discharging latent heat into the lower temperature fluid 19. This construction of the heat exchanger apparatus suffers a problem in that the cost of production of the apparatus becomes high because the heat transfer tubes 5 are constructed as independent heat pipes. Namely, the heat pipe is expensive because it is evacuated and then charged with the heat medium. In addition, the heat pipe is required to have a valve for purging any incondensible gas which is inevitably generated in the heat pipe after long use, otherwise the performance of the heat pipe is impaired by the presence of such incondensible gas. The provision of such a purge valve undesirably raises the cost of the apparatus particularly in the arrangement shown in FIG. 9 because each of a plurality of heat pipes has to have such a purge valve. In addition, the provision of the purge valve on each heat pipe complicates the piping arrangement.

FIG. 10 shows a prior arrangement which has been developed to overcome the problem explained above. In this arrangement, a plurality of heat transfer tubes 5 are connected at their one ends to a common evaporator header 4 and at their other ends to a common condenser header 11, so that the heat transfer tubes 5 in combination constitute a panel. The purge valve 15 mentioned above is provided only on each of gas separator pipes 14 associated with the headers 4, 11, which are common to all heat pipes. According to this arrangement, the evacuation can be conducted for each panel. This arrangement considerably lowers the production cost. The arrangements shown in FIGS. 9 and 10, however, encounter a common problem in that the production process is complicated because all the heat transfer tubes 5 penetrate the partition plate 3. The heat transfer tube 5 is usually provided with a multiplicity of fins 6 for improving the heat transfer. The fins 6 undesirably prevent the heat transfer tube from being inserted into holes formed in the partition plate 3. In consequence, it is necessary that the partition plate 3 is divided into some sections which are placed to embrace the heat transfer tubes and then welded together thus completing the assembly. This work is quite laborious and time-consuming. A troublesome work is required also for providing effective seal in the annular space around each heat transfer tube where it passes through the partition plate. Another problem resides in that the sealing performance is impaired due to difference in the thermal expansion coefficient between the heat transfer tubes and the partition plate.

FIG. 11 shows an improved heat exchanger apparatus which is composed of a hot-fluid casing 1 and a cold-fluid casing 2 which are constructed separately from each other. The hot-fluid casing 1 through which the higher temperature fluid passes accommodates an evaporator panel $P_1$ assembled by a plurality of heat transfer tubes 5 terminating in common headers 4 and 7, while the cold-fluid casing 2 through which the lower temperature fluid passes accommodates a condenser panel $P_2$ assembled by a plurality of heat transfer tubes 9 terminating in common headers 8 and 11. The evaporator panel $P_1$ and the condenser panel $P_2$ are connected to each other through a vapor connection pipe 12 and a liquid connection pipe 13. This heat exchanger apparatus is devoid of any partition plate which is to be penetrated by the heat transfer tubes so that it is possible to eliminate the above-described problems concerning complication in the construction due to the passage of the heat transfer tubes through the partition plate, as well as necessity for the seal. This improved heat exchanger apparatus, however, encounters the following problem. Namely, the circulation of the heat medium in the heat exchanger apparatus is not sufficiently activated unless the condenser panel $P_2$ is positioned at a level considerably higher than the level of the evaporator panel $P_1$. Insufficient medium circulation cannot produce high heat transfer effect. On the contrary, in order to separate any incondensible gas, it is necessary to arrange a gas separator pipe 14 such that the vapor and the condensate flows through this pipe in counter directions. For attaining a high efficiency of the gas separator pipe 14, it is necessary that the vapor inlet is not blocked by the liquid phase of the heat medium. This essentially requires a large difference $H_0$ of height between the evaporator panel $P_1$ and the condenser panel $P_2$. It is also necessary that the evaporator panel $P_1$ accommodates as much liquid as possible, in order to maximize the absorption of heat. This also requires a large height difference between both panels. It is to be understood also that the level of the liquid in the connection pipe 13 is higher than the level $h_1$ of the liquid in the evaporator panel $P_1$ by an amount $h_2$ which corresponds to the pressure loss due to the flow resistance encountered by the heat medium flowing in the connection pipes 12 and 13. Thus, the height difference $H_0$ has to be determined to meet all these demands, so that the size of the apparatus as a whole is increased impractically.

Referring to FIG. 11, a purge pipe 28 is connected at its one end to the gas separator pipe 14 and at its other end to an ejector 29 which is adapted to eject the separated incondensible gas by the action of driving water supplied through a driving water pipe 31 having a stop valve 30.

Figure 1:
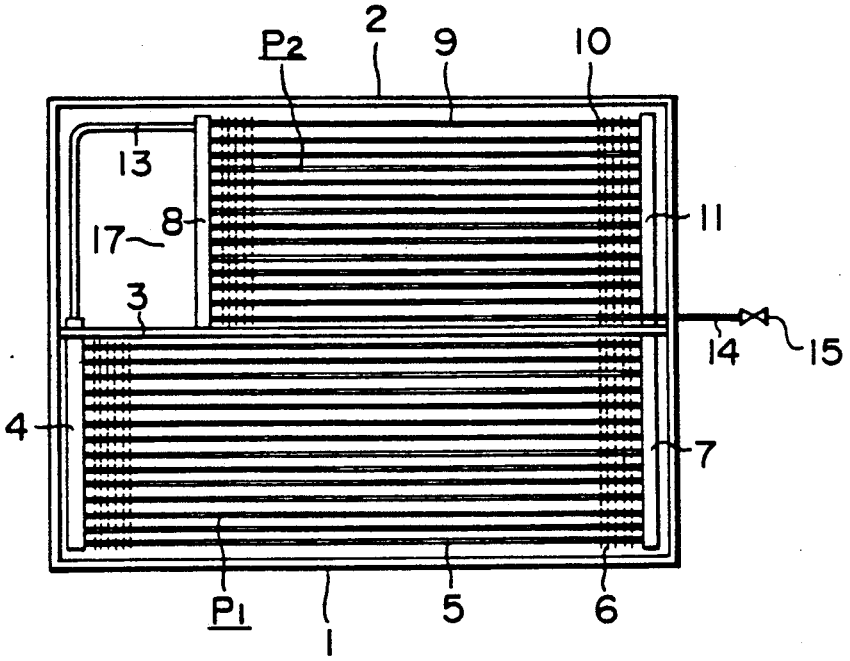
FIG. 1 is a plan view of a first embodiment of the heat exchanger apparatus in accordance with the present invention.
Figure 2:
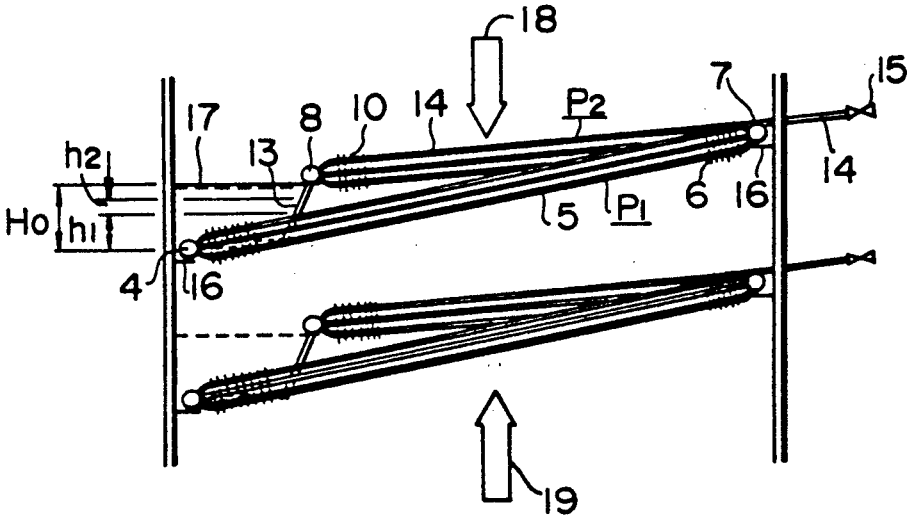
FIG. 2 is a side elevational view of the apparatus shown in FIG. 1.

Referring to FIGS. 1 and 2, a first embodiment of the heat exchanger apparatus according to the present invention has a hot-fluid casing 1 through which the higher temperature fluid 18 passes and a cold-fluid casing 2 through which the lower temperature fluid 19 passes in a direction opposite to the direction of the fluid 18, which are disposed adjacent to each other. The hot-fluid casing 1 incorporates therein an evaporator panel $P_1$ constituted by a plurality of heat transfer tubes 5 which terminate in an evaporator outlet header 7 and an evaporator inlet header 4, each heat-transfer tube 5 having a multiplicity of fins thereon. The cold-fluid casing 2 incorporates therein a condenser panel $P_2$ also constituted by a plurality of heat transfer tubes 9 each having fins 10, which terminate in a condenser inlet header 11 and a condenser outlet header 8. The hot-fluid casing 1 and the cold-fluid casing 2 are separated from each other by means of a partition plate 3. It will be seen that the partition plate 3 is not penetrated by the heat transfer tubes of the panels $P_1$ and $P_2$, because the heat transfer tubes extend in parallel with the partition plate 3. In other words, the partition plate 3 only defines the casings through which different fluids pass.

The heat exchanger apparatus has a gas separator pipe 14 having a valve 15, which rides across the condenser inlet header 11. The gas separator pipe 14 has a function for allowing the separated incondensible gas generated in the panels to be discharged therethrough. A description will be made hereinunder as to the manner in which the evaporator panel $P_1$ and the condenser panel $P_2$ are arranged and connected.

It will be seen that the evaporator outlet header 7 and the condenser inlet header 11 are arranged at the same level and are connected to each other. On the other hand, the evaporator inlet header 4 is positioned below the condenser outlet header 8 by a level $H_0$. The evaporator inlet header 4 and the condenser outlet header 8 are connected to each other through a liquid connection pipe 13. A reference numeral 16 designates baffle plates disposed in the vicinity of the headers 4 and 7 of the evaporator panel $P_1$, while a numeral 17 also designates baffle plates which are disposed in the vicinity of the headers 8 and 11 of the condenser panel $P_2$. The apparatus is of the slant-type one. Namely, the evaporator panel $P_1$ is disposed such that the outlet side thereof is positioned above the inlet side thereof, while the condenser panel $P_2$ is disposed such that its outlet side is positioned below the inlet side thereof.

Figure 14:
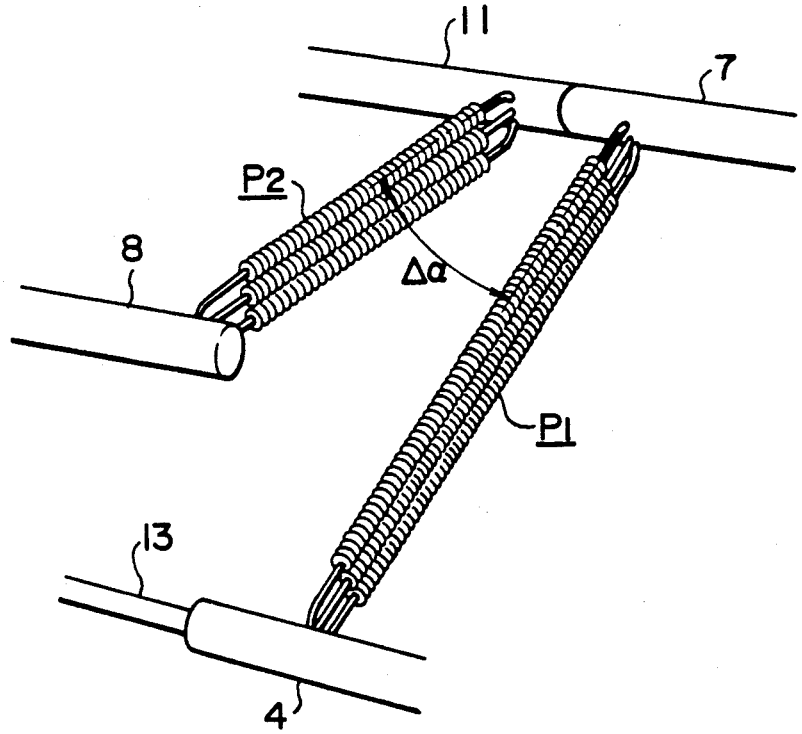
FIG. 14 is a fragmentary perspective view showing a relationship between the heat transfer tubes of the condenser panel and the evaporator panel according to the present invention.

It has been reported that the slant-type heat pipe can operate with the liquid level maintained much lower than that in the upright-type heat pipe and the height difference $h_2$ corresponding to the pressure loss due to the flow resistance of medium also is smaller because the connection pipes need not be bent so sharply as that in the upright-type heat pipe. In consequence, the slant-type heat pipe can operate with much smaller overall height difference $H_0$ of headers as the sum of the height difference $h_2$ and the liquid level $h_1$. Thus, the angular difference $\Delta\alpha$ between the evaporator panel $P_1$ and the condenser panel $P_2$ may be as small as 5° to 10° (see FIG. 14). In this embodiment, both panels $P_1$ and $P_2$ are inclined to a direction of the force of gravity. However, it is not necessary for the condenser panel $P_2$ to be inclined to the direction of the force of gravity. The panel $P_2$ may extend perpendicular to the direction of the force of gravity, i.e. extend horizontally.

In operation, the liquid phase of the heat medium filling the lower part of the evaporator panel $P_1$ generates bubbles as it is heated by the higher temperature fluid 18. As the bubbles grow to a certain level of size, they push up the liquid, thus exhibiting boiling phenomenon. The height by which the liquid is pushed up is proportional to the length of the liquid column. In case of the vertical-type, the height of the liquid column is required to be half of the length of the heat transfer tube. Thus, in the case of the tube having a length of 3000 mm, the length of the liquid column is required to be about 1500 mm. When this tube is inclined to an elevation angle of 30°, the pipe height is reduced to 1500 ($=3000\times\sin 30°$) mm, so that the required height of the liquid column also is reduced to about 750 mm.

Figure 5:
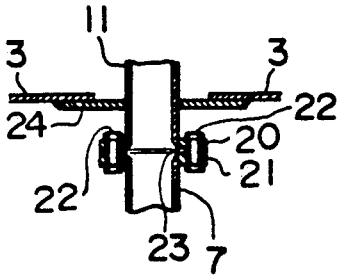
FIGS. 5 and 6 are fragmentary enlarged sectional views of constructions for connecting the headers to each other.
Figure 6:
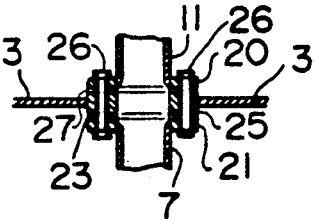

FIGS. 5 and 6 show the manners in which the headers 7 and 11 are connected to each other. In the arrangement shown in FIG. 5, the header 11 of the condenser panel $P_2$ is slightly projected into the hot-fluid casing 1 through a hole formed in an adapter plate 24 secured to an opening of the partition plate 3. Flanges 20 and 21 provided on both headers 11 and 7 are connected to each other by means of bolts 22 through a packing 23 interposed therebetween.

In the arrangement shown in FIG. 6, a flange seat 25 is formed on the partition plate 3 and the flanges 20 and 21 of the respective headers 11 and 7 are fixed to the flange seat 25 by means of bolts 26 through packings 23, 27.

Figure 3:
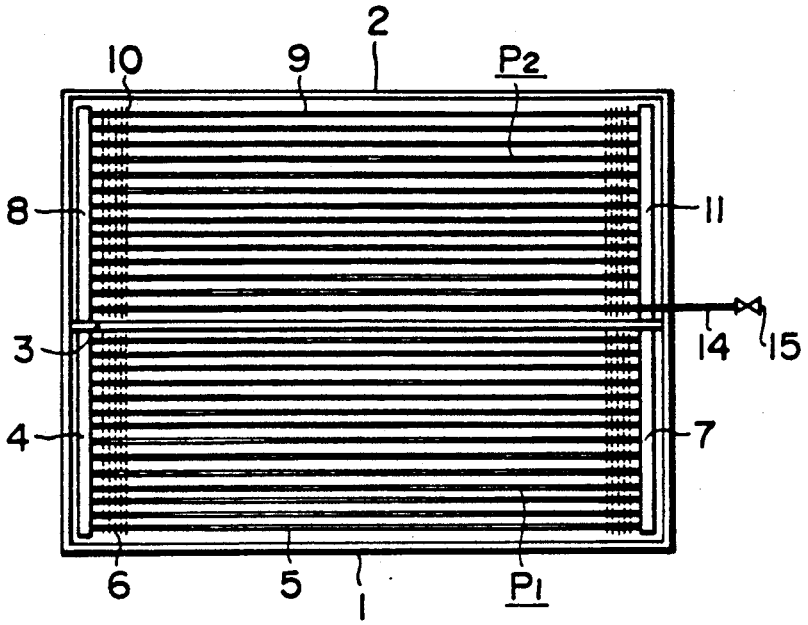
FIG. 3 is a plan view of a second embodiment of the heat exchanger apparatus in accordance with the present invention.
Figure 4:
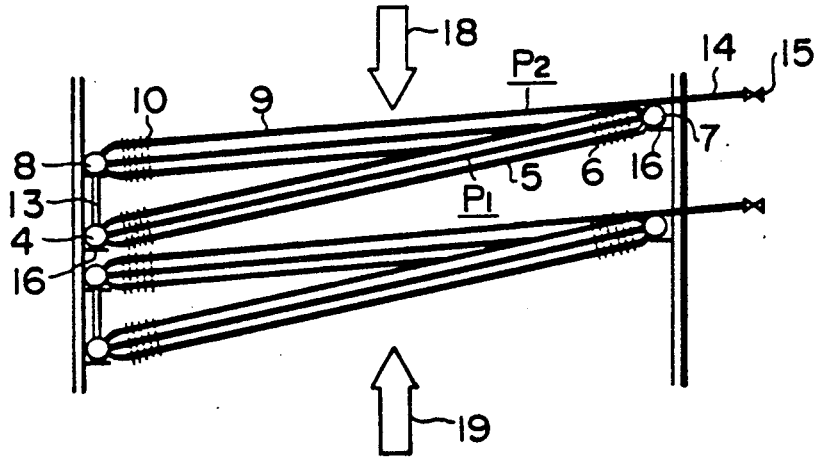
FIG. 4 is a side elevational view of the apparatus shown in FIG. 3.

FIGS. 3 and 4 show a second embodiment of the heat exchanger apparatus in accordance with the present invention. In this embodiment, the heat transfer tube constituting the evaporator panel $P_1$ has a length slightly greater than that of the heat transfer tube constituting the condenser panel $P_2$. This arrangement eliminates the necessity for provision of a large baffle in the cool-fluid casing 2 in which the condenser panel $P_2$ is disposed, so that the space in the cold-fluid casing 2 can be utilized efficiently.

Figure 7:
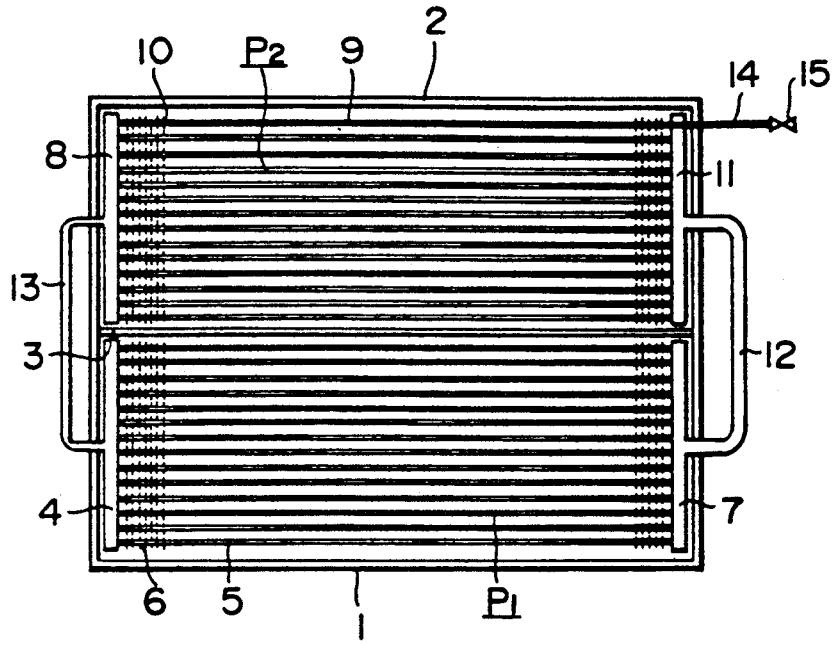
FIG. 7 is a plan view of a third embodiment of the heat exchanger apparatus in accordance with the present invention.
Figure 8:
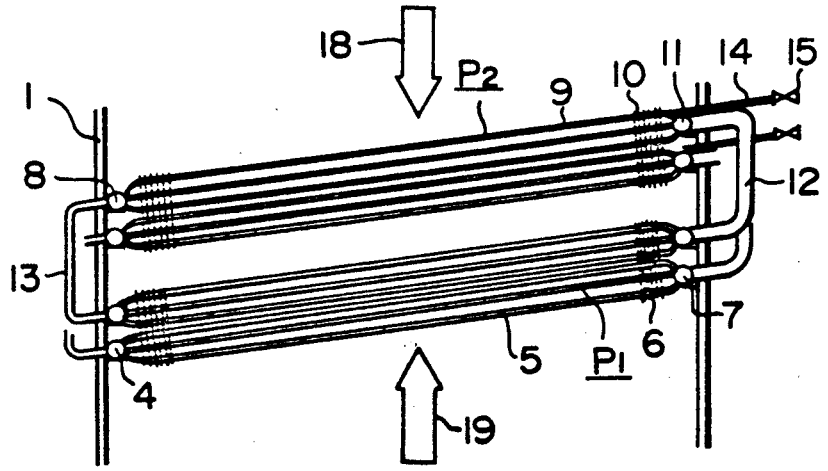
FIG. 8 is a side elevational view of the apparatus shown in FIG. 7.

FIGS. 7 and 8 show a third embodiment of the heat exchanger apparatus in accordance with the present invention. In this embodiment, the partition plate 3 is penetrated by no pipe. Namely, the vapor connection pipe 12 and the liquid connection pipe 13 are laid outside the hot-fluid casing 1 and the cool-fluid casing 2 so as to provide a connection between both panels. In this case, the headers 7 and 11 of the evaporator panel $P_1$ and the condenser panel $P_2$ are not directly connected to each other, so that it is not necessary to install these headers at the same level. This in turn eliminates the necessity for providing a difference in the inclination angle between the evaporator panel $P_1$ and the condenser panel $P_2$ for the purpose of the circulation of the heat medium. Therefore, in this embodiment, the panels $P_1$ and $P_2$ may be arranged substantially in parallel to each other as shown in FIG. 8. Namely, the angular difference $\Delta\alpha$ becomes zero.

Figure 12:
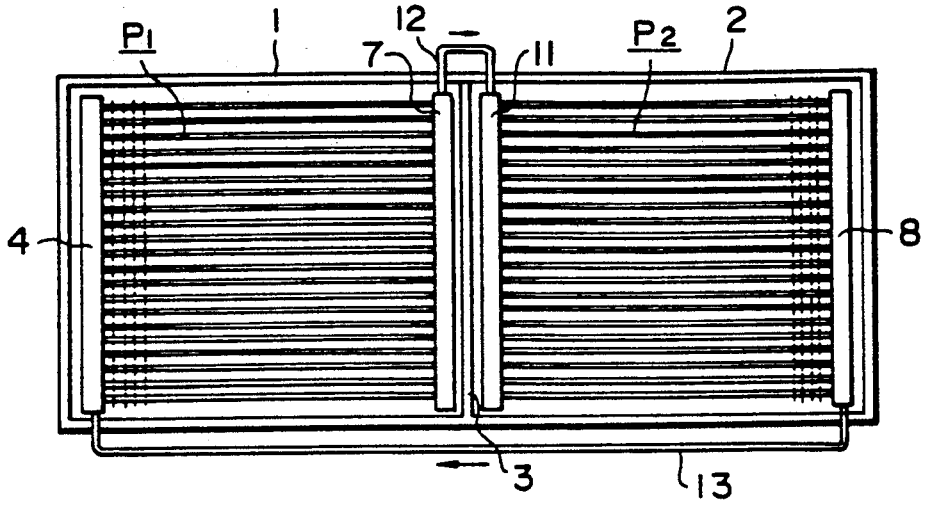
FIG. 12 is a plan view of a fourth embodiment of the heat exchanger apparatus in accordance with the present invention.
Figure 13:
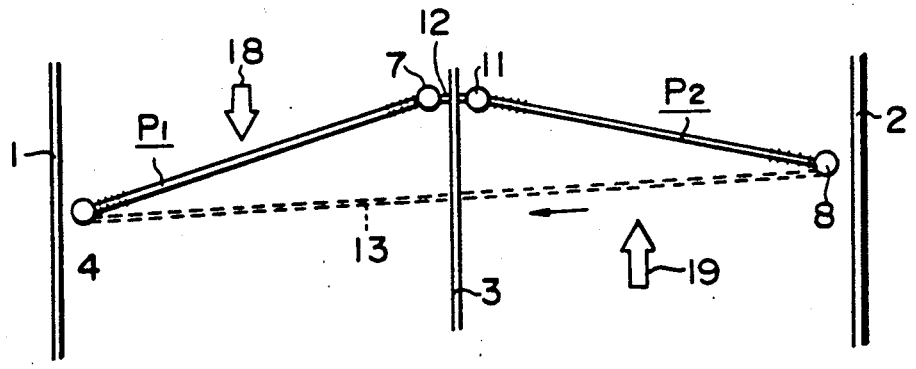
FIG. 13 is a side elevational view of the apparatus shown in FIG. 12.

FIGS. 12 and 13 show a fourth embodiment of the present invention. In contrast to the preceding embodiments in which the heat transfer tubes are in parallel to the partition plate 3, the fourth embodiment is characterized in that the heat transfer tubes of both panels $P_1$ and $P_2$ are arranged at a right angle to the partition plate 3 on both sides of the latter. It will be understood that this arrangement also contributes to the compact design of the heat exchanger apparatus as a whole because the partition plate 3 is not penetrated by the heat transfer tubes constituting the evaporator panel $P_1$ and the condenser panel $P_2$.

As will be understood from the foregoing description, the heat exchanger apparatus of the present invention has a compact construction by virtue of the fact that the hot-fluid casing and the cold-fluid casing are disposed adjacent to each other. In addition, the partition plate which separates the hot-fluid casing and the cold-fluid casing from each other is not penetrated by the heat transfer tubes constituting the evaporator panel and the condenser panel. Furthermore, the evaporator panel and the condenser panel which are disposed adjacent to each other are mutually connected through connection pipes and these panels are disposed at a predetermined small height difference, so that vigorous circulation of the heat medium is ensured. According to the invention, therefore, the size of the heat exchanger apparatus as a whole is reduced. In addition, the production cost also is reduced appreciably by virtue of elimination of troublesome works in the production process such as the assembly of the partition plate for allowing the heat-transfer tube to penetrate the partition plate.

What is claimed is:

1. A heat exchanger apparatus of the slant-type having tubes extending substantially horizontally but inclined to a direction of the force of gravity comprising:

a hot fluid casing through which a fluid of a higher temperature passes;

a cold-fluid casing disposed adjacent to said hot-fluid casing, through which a fluid of a lower temperature passes;

common partition means separating said casings from each other condenser tube groups disposed in said cold-fluid casing and constituted by a plurality of heat transfer tubes each charged with a heat medium, said heat transfer tubes being connected at one end thereof to a condenser inlet header and at the other end thereof to a condenser outlet header, and said heat transfer tubes extending inclined to a direction of the force of gravity;

evaporator tube groups disposed in said hot-fluid casing and constituted by a plurality of heat transfer tubes each charged with a heat medium, said heat transfer tubes being connected at one end thereof to an evaporator inlet header and at the other end thereof to an evaporator outlet header, and said heat transfer tubes extending inclined to a direction of the force gravity;

connection pipes through which said condenser tube groups and said evaporator tube groups are connected to each other for allowing said heat medium to be circulated through said tube groups, and wherein said condenser tue groups are so disposed that the condenser inlet header is positioned above the condenser outlet header, while said evaporator tube groups are so disposed that the evaporator inlet header is positioned below the evaporator outlet header, wherein a height difference between the condenser outlet header and the evaporator inlet header is sufficient to generate a pressure head to circulate said heat medium through said tube groups and wherein said condenser tube groups and said evaporator tube groups extend substantially parallel to said partition means.

2. A heat exchanger apparatus according to claim 1, wherein said condenser inlet header and said evaporator outlet header are arranged substantially at the same level and connected to each other, and wherein said condenser outlet header is disposed above said evaporator inlet header, and said condenser outlet head and said evaporator inlet header are connected to each other through a liquid connection pipe.

3. A heat exchanger apparatus according to claim 1, wherein said condenser inlet header and said evaporator outlet header are connected to a connection pipe extending through said hot-fluid casing and said cold-fluid casing, and wherein said condenser outlet header and said evaporator inlet header are connected to a connection pipe extending through said hot-fluid casing and said cold-fluid casing.

4. A heat exchanger apparatus according to claim 3, wherein said condenser tube groups and said evaporator tube groups connected to said condenser tube groups through the associated connection pipe are arranged substantially at the same inclination angle, and wherein said condenser tube group is disposed above said evaporator tube group.

5. A heat exchanger apparatus according to claim 1, wherein said condenser tube groups and said evaporator tube groups connected to said condenser tube groups through the associated connection pipe ar arranged substantially at the same inclination angle, and wherein said condenser tube groups are disposed above said evaporator tube groups.

6. A heat exchanger apparatus of the slant-type having tubes extending substantially horizontally but inclined to a direction of the force of gravity comprising:

means for encasing a hot fluid of a higher temperature passing through said heat exchanger;

means for encasing a cold fluid of a lower temperature passing through said heat exchanger adjacent to said hot fluid passing through said heat exchanger but separated therefrom by common partition means of the encasing means;

condenser tube groups disposed in said means for encasing a cold fluid and constituted by a plurality of heat transfer tubes each charged with a heat medium, said heat transfer tubes being connected at one end thereof to a condenser inlet header and at the other end thereof to a condenser outlet header, and said heat transfer tubes extending inclined to a direction of the force of gravity;

evaporator tube groups disposed in said means for encasing a hot fluid and constituted by a plurality of heat transfer tubes each charged with a heat medium, said heat transfer tubes being connected at one end thereof to an evaporator outlet header, and said heat transfer tubes extending inclined to a direction of the force of gravity;

connection pipes through which said condenser tube groups and said evaporator tube groups are connected to each other for allowing said heat medium to be circulated through said tube groups; and wherein said condenser tube groups are so disposed that the condenser inlet header is positioned above the condenser outlet header, while said evaporator tube groups are so disposed that the evaporator inlet header is positioned below the evaporator outlet header, wherein a height difference between the condenser outlet header and the evaporator inlet header is sufficient to generate a pressure head to circulate said heat medium through said tube groups extend substantially parallel to said partition means.

7. A heat exchanger apparatus of the slant-type having tubes extending substantially horizontally but inclined to a direction of the force of gravity comprising:

a hot fluid casing through which a fluid of a higher temperature passes;

cold-fluid casing disposed adjacent to said hot-fluid casing, through which a fluid of a lower temperature passes;

condenser tube groups disposed in said cold-fluid casing and constituted by a plurality of heat transfer tubes each charged with a heat medium, said heat transfer tubes being connected at one end thereof to a condenser inlet header and at the other end thereof to a condenser outlet header, and said heat transfer tubes extending inclined to a direction of the force of gravity;

evaporator tube groups disposed in said hot-fluid casing and constituted by a plurality of heat transfer tubes each charged with a heat medium, said heat transfer tubes being connected at one end thereof to an evaporator inlet header and at the other end thereof to an evaporator outlet header, and said heat transfer tubes extending inclined to a direction of the force of gravity;

connection pipes through which said condenser tube groups and said evaporator tube groups are connected to each other for allowing said heat medium to be circulated through said tube groups, and wherein said condenser tube groups are so disposed that the condenser inlet header is positioned above the condenser outlet header, while said evaporator tube groups are so disposed that the evaporator inlet header is positioned below the evaporator outlet header, wherein a height difference between the condenser outlet header and the evaporator inlet header is sufficient to generate a pressure head to circulate said heat medium through said tube groups and wherein said condenser tube groups and said evaporator tube groups extend substantially parallel to each other.

8. A heat exchanger apparatus according to claim 7, wherein said condenser inlet header and said evaporator outlet header are connected to a connection pipe extending through said hot-fluid casing and said cold-fluid casing, and wherein said condenser outlet header and said evaporator inlet header are connected to a connection pipe extending through said hot-fluid casing and said cold-fluid casing.

9. A heat exchanger apparatus according to claim 8, wherein said condenser tube groups and said evaporator tube groups connected to said condenser tube groups through the associated connection pipe are arranged substantially at the same inclination angle, and wherein said condenser tube group is disposed above said evaporator tube group.

10. A heat exchanger apparatus according to claim 7, wherein said condenser tube groups and said evaporator tube groups connected to said condenser tube groups through the associated connecting pipe are arranged substantially at the same inclination angle, and wherein said condenser tube groups are disposed above said evaporator tube groups.

11. A heat exchanger apparatus of the slant-type having tubes extending substantially horizontally but inclined to a direction of the force of gravity comprising:

means for encasing a hot fluid of a higher temperature passing through said heat exchanger;

means for encasing a cold fluid of a lower temperature passing through said heat exchanger adjacent to said hot fluid passing through said heat exchanger but separated therefrom;

condenser tube groups disposed in said means for encasing a cold fluid and constituted by a plurality of heat transfer tubes each charged with a heat medium, said heat transfer tubes being connected at one end thereof to a condenser inlet header and at the other end thereof to a condenser outlet header, and said heat transfer tubes extending inclined to a direction of the force of gravity;

evaporator tube groups disposed in said means for encasing a hot fluid and constituted by a plurality of heat transfer tubes each charged with a heat medium, said heat transfer tubes being connected at one end thereof to an evaporator outlet header, and said heat transfer tubes extending inclined to a direction of the force of gravity;

connection pipes through which said condenser tube groups and said evaporator tube groups are connected to each other for allowing said heat medium to be circulated through said tube groups; and wherein said condenser tube groups are so disposed that the condenser inlet header is positioned above the condenser outlet header, while said evaporator tube groups are so disposed that the evaporator inlet header is positioned below the evaporator outlet header, wherein a height difference between the condenser outlet header and the evaporator inlet header is sufficient to generate a pressure head to circulate said heat medium through said tube groups and wherein said condenser tube groups and said evaporator tube groups extend substantially parallel to each other.

* * * * *